US008978317B1

(12) United States Patent
Inzeo

(10) Patent No.: US 8,978,317 B1
(45) Date of Patent: Mar. 17, 2015

(54) COPING FOR ATTACHMENT TO A WALL WITH A NON-STRUCTURAL EXTERIOR BUILDING FACADE

(71) Applicant: Joseph A. Inzeo, West Allis, WI (US)

(72) Inventor: Joseph A. Inzeo, West Allis, WI (US)

(73) Assignee: Metal-Era, Inc., Waukesha, WI (US)

( * ) Notice: Subject to any disclaimer, the term of this patent is extended or adjusted under 35 U.S.C. 154(b) by 0 days.

(21) Appl. No.: 14/252,183

(22) Filed: Apr. 14, 2014

(51) Int. Cl.

| | |
|---|---|
| ***E04D 1/36*** | (2006.01) |
| ***E04F 19/02*** | (2006.01) |
| *E04D 3/40* | (2006.01) |
| *E04D 13/155* | (2006.01) |

(52) U.S. Cl.
CPC . *E04F 19/02* (2013.01); *E04D 1/36* (2013.01); *E04D 3/405* (2013.01); *E04D 13/155* (2013.01)
USPC ..... 52/60; 52/198; 52/300

(58) Field of Classification Search
CPC ..... E04D 1/36; E04D 3/405; E04D 13/155
USPC ..... 52/60, 198, 300
See application file for complete search history.

(56) References Cited

U.S. PATENT DOCUMENTS

| | | | | |
|---|---|---|---|---|
| 3,862,531 | A * | 1/1975 | Attaway et al. | 52/300 |
| 4,083,158 | A * | 4/1978 | Wolma | 52/300 |
| 4,550,535 | A * | 11/1985 | Drogosch | 52/60 |
| 4,858,406 | A * | 8/1989 | Lane et al. | 52/300 |
| 5,289,662 | A * | 3/1994 | Castle | 52/287.1 |
| 5,893,247 | A * | 4/1999 | Hickman et al. | 52/300 |
| 6,216,408 | B1 * | 4/2001 | Davidson | 52/300 |
| 7,168,209 | B2 * | 1/2007 | Heidler, Jr. | 52/60 |
| 7,748,173 | B1 * | 7/2010 | Inzeo et al. | 52/60 |
| 8,001,739 | B1 * | 8/2011 | Inzeo et al. | 52/300 |
| 8,561,367 | B2 * | 10/2013 | Kelly | 52/300 |
| 2005/0028464 | A1 * | 2/2005 | Kay et al. | 52/300 |
| 2005/0235578 | A1 * | 10/2005 | Heidler | 52/58 |

* cited by examiner

*Primary Examiner* — Basil Katcheves
*Assistant Examiner* — Joshua Ihezie
(74) *Attorney, Agent, or Firm* — Donald J. Ersler

(57) ABSTRACT

A coping for attachment to a wall with an exterior building facade includes at least one anchor clip and a coping cover. The anchor clip includes a clip support channel, a cover support and a spring support. The clip support channel includes a top member, a first side member and a second side member. The spring support is attached to the top member on a first end. The cover support is attached to the top member and the second side member. The coping cover includes a top surface, a first side surface and a second side surface. A bottom end of the first and second side surfaces are terminated with first and second attachment clips. The coping cover is attached to the at least one anchor clip. The facade coping system also includes a splice channel, a corner support clip, a corner coping cover and an end cap coping cover.

18 Claims, 9 Drawing Sheets

COPING FOR ATTACHMENT TO A WALL WITH A NON-STRUCTURAL EXTERIOR BUILDING FACADE

BACKGROUND OF THE INVENTION

1. Field of the Invention

The present invention relates generally to building construction and more specifically to a coping for attachment to a wall with a non-structural exterior building facade, which is not anchored to the exterior building facade.

2. Discussion of the Prior Art

There are numerous types of non-structural exterior building facades, such as metal panels, exterior insulation finishing systems, or masonry panels. However, a drawback of the exterior building facades is their lack of structural integrity for the attachment of copings. U.S. Pat. No. 5,893,247 to Hickman et al. discloses a coping. U.S. Pat. No. 6,216,408 to Davidson discloses a coping assembly. U.S. Pat. No. 8,001,739 to Inzeo et al. discloses a parapet wall cover system.

Accordingly, there is a clearly felt need in the art for a coping for attachment to a wall with a non-structural exterior building facade, which is anchored to a wall and not the exterior building facade.

SUMMARY OF THE INVENTION

The present invention provides a coping for attachment to a wall with a non-structural exterior building facade, which is not anchored to the exterior building facade. The coping for attachment to a wall with a non-structural exterior building facade (facade coping system) preferably includes at least one anchor clip and a coping cover. The anchor clip includes a clip support channel, a cover support and a spring support. The clip support channel includes a top member, a first side member and a second side member. The first side member extends downward from a first end of the top member and the second side member extends downward from a second end of the top member. A bottom end of the first side member is terminated with a first offset flange and a bottom end of the second side member is terminated with a second offset flange. A plurality of first holes are preferably formed through the clip support channel, adjacent a first side thereof and a plurality of second holes are preferably formed through the clip support channel, adjacent a second side thereof.

The cover support includes a horizontal portion and a vertical portion. The cover support preferably includes a hat channel cross section. However, other cross sections may also be used. The hat channel cross section includes a support member, two vertical members and two flange members. The two vertical members extend downward from opposing sides of the support member. The two flange members extend outward from a bottom of the two vertical members. The two flange members and the two vertical member are notched to allow the horizontal and vertical portions to be bent substantially perpendicular to each other. The horizontal portion of the cover support is attached to the top member and the vertical portion is attached to the second side member. The spring support includes a base member and a support member. The support member extends upward from the base member. The base member is attached to the top member, adjacent the first side member.

The coping cover includes a top surface, a first side surface and a second side surface. The first side surface extends downward from one side of the top surface and the second side surface extends downward from the other side of the top surface. A bottom end of the first side surface is terminated with a first attachment clip. A bottom end of the second side member is terminated with a second attachment clip.

The facade coping system also includes a splice channel, a corner support clip, a corner coping cover and an end cap coping cover. The splice channel includes a top surface, a first side surface and a second side surface. The first side surface extends downward from a first side of the top surface and the second side surface extends downward from a second side of the top surface. The corner support clip includes a corner base member and a cover support member. The cover support member is attached to a top of the corner base member. The corner coping cover includes two shortened coping covers. Each shortened coping cover is mitered on one end. The mitered ends are joined to each other with any suitable attachment process. The end cap coping cover includes a shortened coping cover and an end plate. The end plate is attached to one end of the shortened coping cover.

The facade coping system is preferably attached to a wall in the following manner. The at least one anchor clip is attached to a top of the wall with a plurality of fasteners or the like. The second attachment clip of the coping cover is hooked on the second offset flange of the clip support channel. The first attachment clip of the cover channel is pushed over the spring support and hooked on the first offset flange.

Accordingly, it is an object of the present invention to provide a facade coping system, which is anchored to a wall and not to an exterior building facade.

These and additional objects, advantages, features and benefits of the present invention will become apparent from the following specification.

DETAILED DESCRIPTION OF THE PREFERRED EMBODIMENTS

Figure 13:
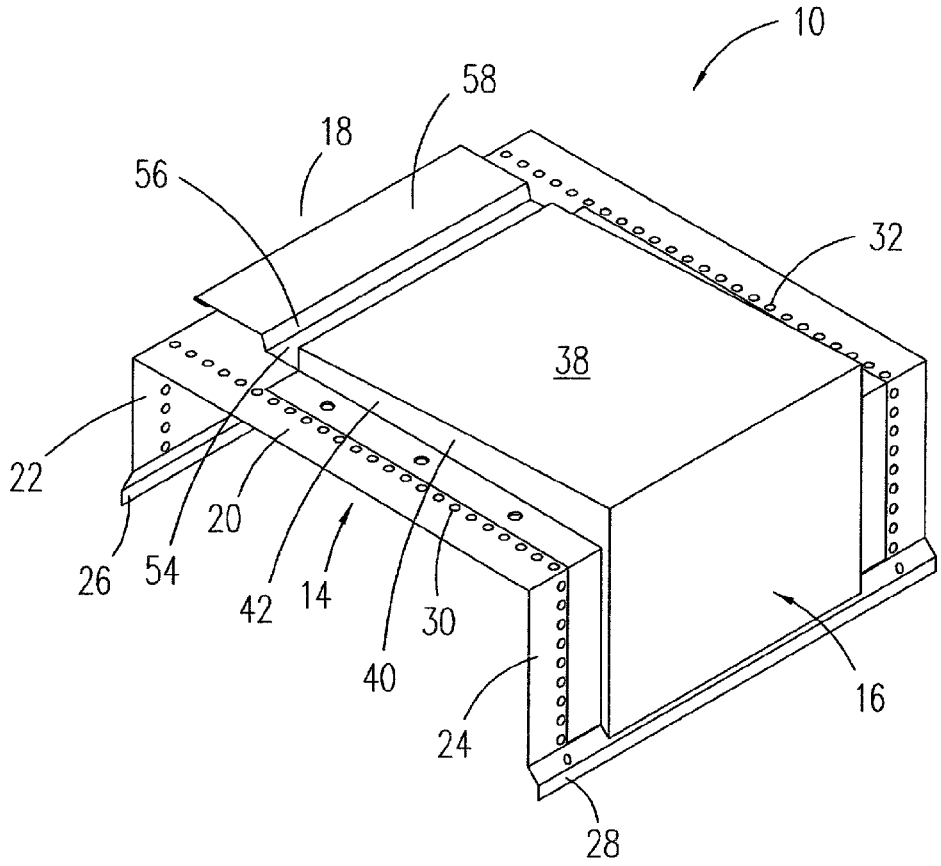
FIG. 13 is a perspective view of an anchor clip of a facade coping system in accordance with the present invention.
Figure 17:
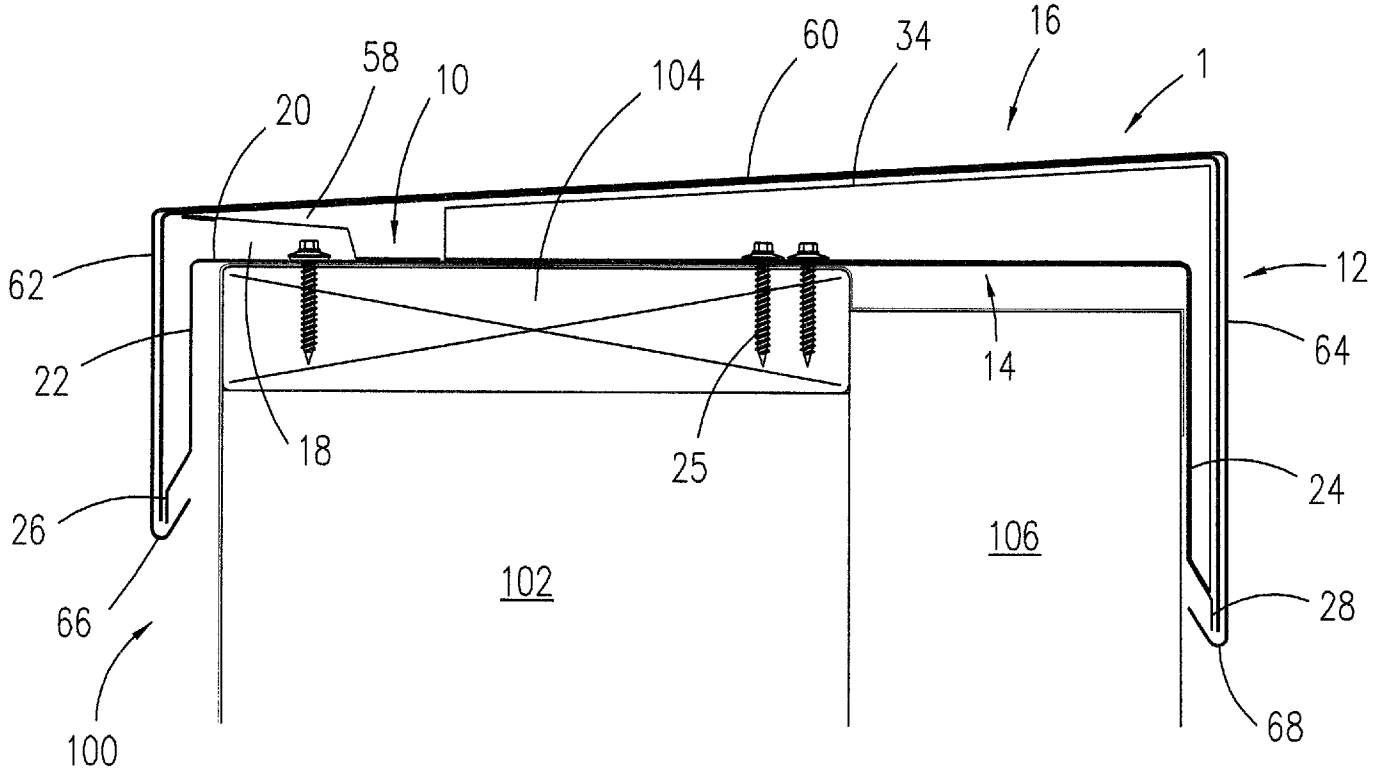
FIG. 17 is a cross sectional view of an anchor clip attached to a wall, a splice channel placed on the anchor clip and a coping cover retained on the anchor clip of a facade coping system in accordance with the present invention.

With reference now to the drawings, and particularly to FIG. 17, there is shown a cross sectional view of a facade coping system 1 retained on a wall 100. The wall 100 includes a base portion 102, a fastener stud 104 and a facade 106. The facade coping system 1 preferably includes at least one anchor clip 10 and a coping cover 12. With reference to FIG. 13, the anchor clip 10 includes a clip support channel 14, a cover support 16 and a spring support 18. The clip support channel 14 includes a top member 20, a first side member 22 and a second side member 24. The first side member 22 extends downward from a first end of the top member 20 and the second side member 24 extends downward from a second end of the top member 20. A bottom end of the first side member 22 is terminated with a first offset flange 26 and a bottom end of the second side member 24 is terminated with a second offset flange 28.

Figure 8:
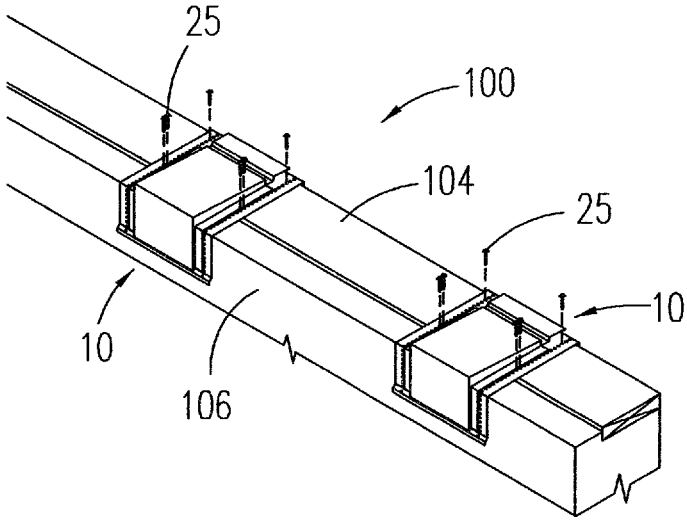
FIG. 8 is a perspective view of two anchor clips attached to a wall of a facade coping system in accordance with the present invention.

A plurality of first holes 30 are formed through the clip support channel 14, adjacent a first side thereof and a plurality of second holes 32 are formed through the clip support channel, adjacent a second side thereof. With reference to FIG. 8, the anchor clip 10 is attached to the fastener stud 104 by inserting a plurality of fasteners 25 through the first and second holes 30, 32 and securing the plurality of fasteners 25 to the fastener stud 104.

With reference to FIG. 17, the coping cover 12 includes a top surface 60, a first side surface 62 and a second side surface 64. The first side surface 60 extends downward from a first side of the top surface 60 and the second side surface 64 extends downward from a second side of the top surface 20. A bottom end of the first side surface 62 is terminated with a first attachment clip 66. A bottom end of the second side surface 64 is terminated with a second attachment clip 68. The coping cover 12 is installed on the anchor clip 10 by hooking the second attachment clip 68, under the second offset flange 28. The first attachment clip 66 is pushed over the first end of the clip support channel 14 and below the first offset flange 26, until the first attachment clip 66 hooks the first offset flange 26. The spring support member 58 will pivot downward to allow the first attachment clip 66 to be pushed below the first offset flange 26.

The second portion 36 includes a second support member 48, two second vertical members 50 and two second flange members 52. The two second vertical members 50 are bent to extend downward from opposing sides of the second support member 48. The two second flange members 52 are bent to extend outward from a bottom of the two second vertical members 50. The first portion 34 is bent substantially perpendicular to the second portion 36 on the bend line 35. The tabs 46 are secured to first vertical members 40 with any suitable attachment process, such as Lance Lock. The first portion 34 is attached to the top member 20 with any suitable attachment process, such as Lance Lock. The second portion 36 is attached to the second side member 24.

The spring support 18 preferably includes a spring base member 54, spring vertical member 56 and a spring support member 58. The vertical member 56 extends upward from the base member 54 and the spring support member 58 extends outward from spring vertical member 56. The spring base member 54 is attached to the top member 20, adjacent the first side member 22 with any suitable attachment process, such as Lance Lock.

With reference to FIG. 17, the coping cover 12 includes a top surface 60, a first side surface 62 and a second side surface 64. The first side surface 60 extends downward from a first side of the top surface 60 and the second side surface 64 extends downward from a second side of the top surface 20. A bottom end of the first side surface 62 is terminated with a first attachment clip 66. A bottom end of the second side member is terminated with a second attachment clip 68. The coping cover 12 is installed on the anchor clip 10 by hooking the second attachment clip 68, under the second offset flange 28. The first attachment clip 66 is pushed over the first end of the clip support channel 14 and below the first offset flange 26, until the first attachment clip 66 hooks the first offset flange 26. The spring support member 58 will pivot downward to allow the first attachment clip 66 to be pushed below the first offset flange 26.

Figure 2:
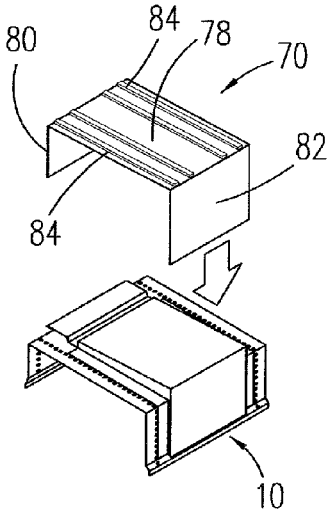
FIG. 2 is a perspective view of a splice channel before attachment to an anchor clip of a facade coping system in accordance with the present invention.
Figure 9:
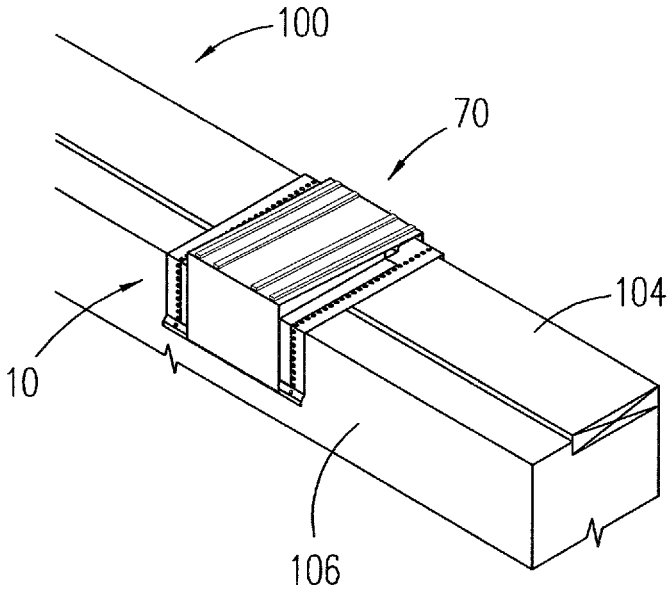
FIG. 9 is a perspective view of an anchor clip attached to a wall shown in FIG. 8 and a splice channel placed on the anchor clip of a facade coping system in accordance with the present invention.
Figure 10:
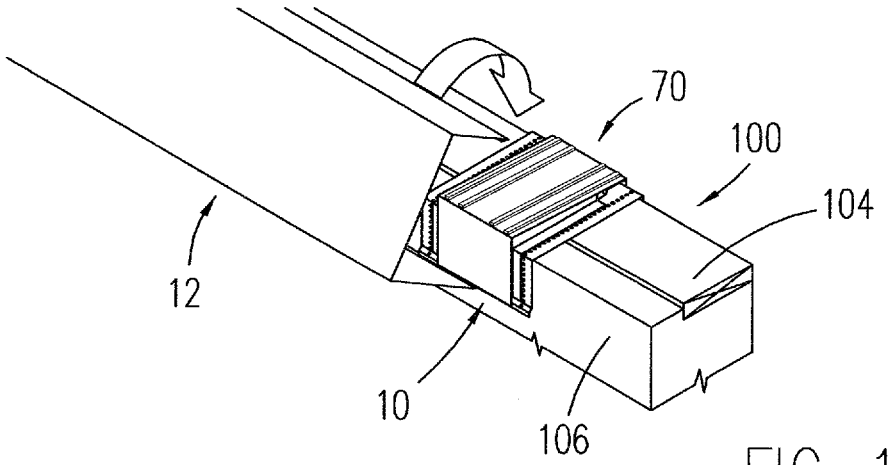
FIG. 10 is a perspective view of an anchor clip attached to a wall of FIG. 9, a splice channel placed on the anchor clip and a coping cover hooked on the anchor clip of a facade coping system in accordance with the present invention.
Figure 11:
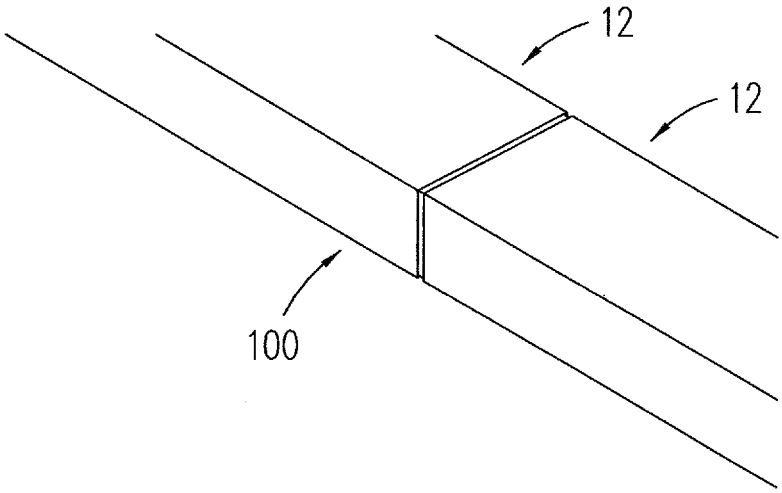
FIG. 11 is a perspective view of two adjacent coping covers retained on an anchor clip and splice channel of a facade coping system in accordance with the present invention.
Figure 12:
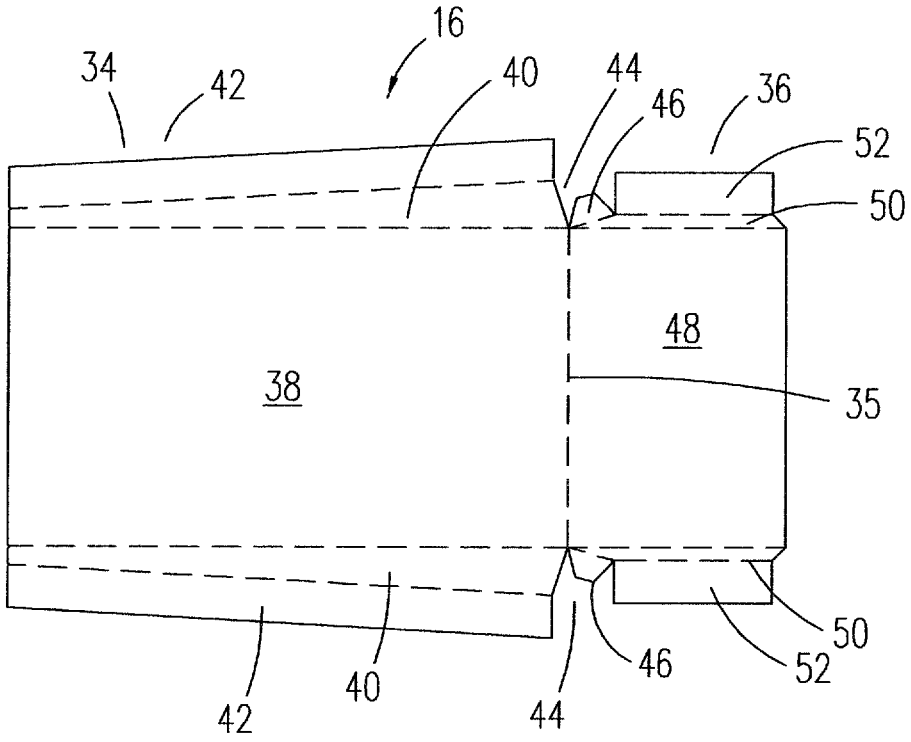
FIG. 12 is a top view of a flat plane layout of a cover support of an anchor clip of a facade coping system in accordance with the present invention.

With reference to FIGS. 2-3, 7 and 14-16, the facade coping system 1 also includes a splice channel 70, a corner support clip 72, a corner coping cover 74 and an end cap coping cover 76. With reference to FIG. 2, the splice channel 70 includes a top surface 78, a first side surface 80 and a second side surface 82. The first side surface 80 extends downward from a first side of the top surface 78 and the second side surface 82 extends downward from a second side of the top surface 78. At least two rows of butyl sealant 84 are preferably applied to the top surface 78. The butyl sealant 84 seals two adjacent coping covers 12, 74, 76. With reference to FIG. 9, the splice channel 70 is placed over the anchor clip 10. With reference to FIG. 10, a first coping cover 12 is secured to the anchor clip 10 with the splice channel 70. With reference to FIG. 11, a second coping cover 12 is attached to the anchor clip 10 with the splice channel 70.

Figure 14:
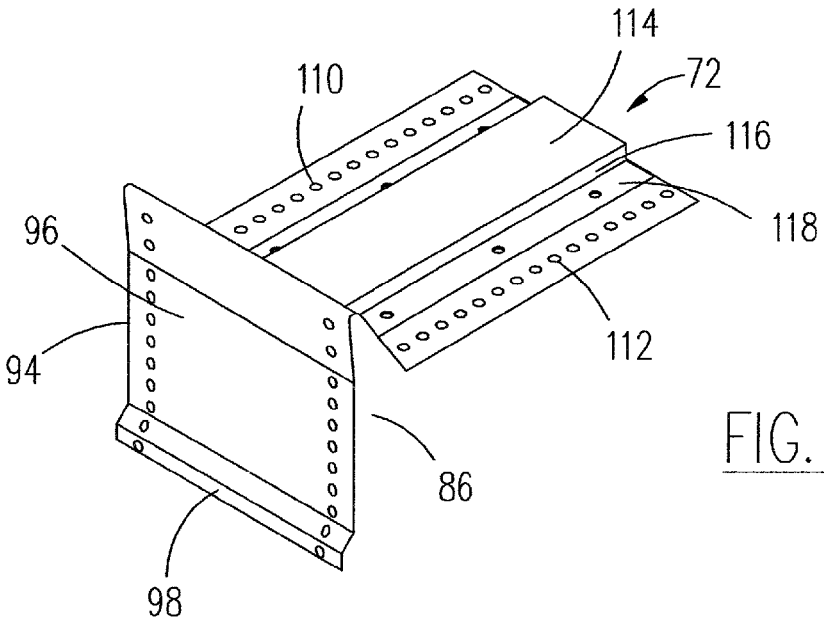
FIG. 14 is a front perspective view of a corner support clip of a facade coping system in accordance with the present invention.
Figure 15:
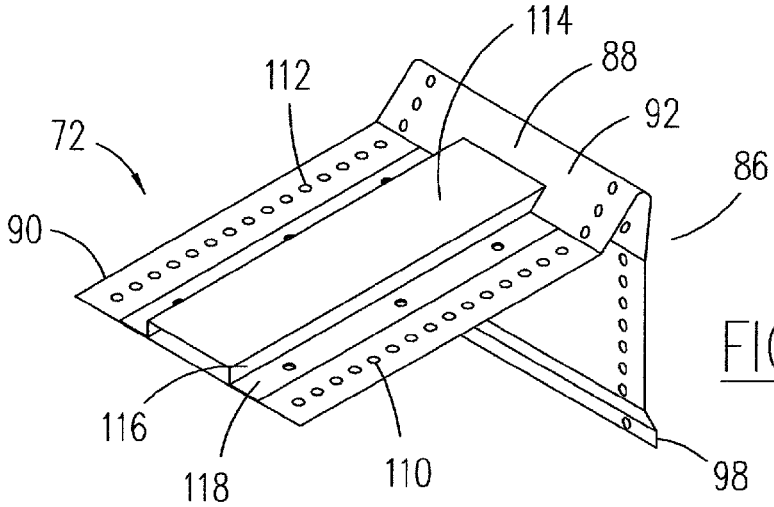
FIG. 15 is a rear perspective view of a corner support clip of a facade coping system in accordance with the present invention.
Figure 16:
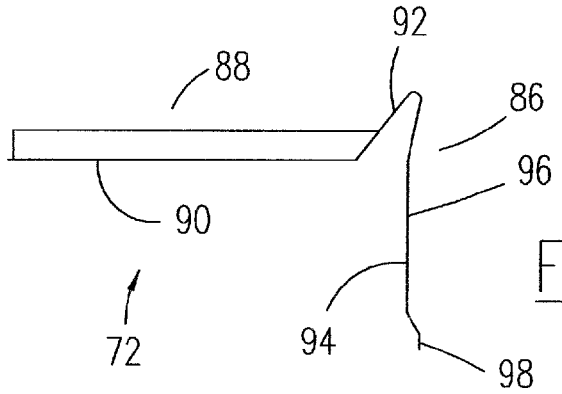
FIG. 16 is an end view of a corner support clip of a facade coping system in accordance with the present invention.

With reference to FIGS. 14-16, the corner support clip 72 includes a corner base member 86 and a cover support member 88. The corner base member 86 preferably includes a top member 90, a ramp member 92 and a side member 94. One end of the ramp member 92 extends upward from one end of the top member 90 and the side member 94 extends downward from the other end of the ramp member 92. The side member 94 preferably includes a depressed area 96, such that the coping covers 12, 74, 76 do not contact a middle of the side member 94. A bottom of the side member 94 is terminated with an offset flange 98. A plurality of first holes 110 are formed through the corner base member 86, adjacent a first side thereof and a plurality of second holes 112 are formed through the corner base member 86, adjacent a second side thereof.

Figure 1:
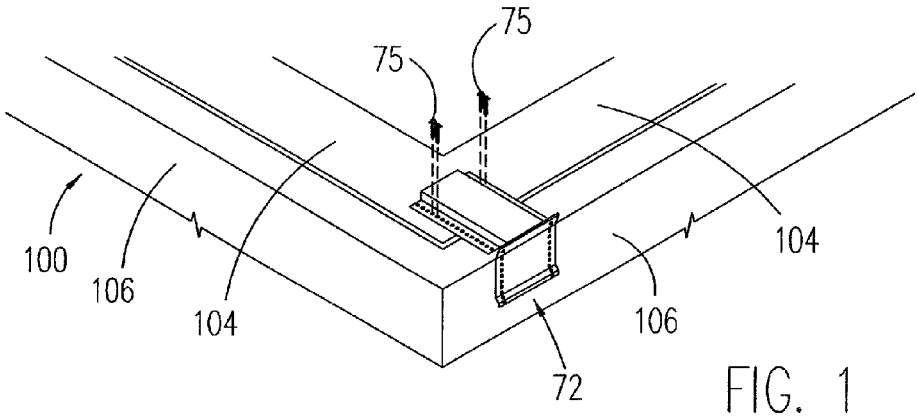
FIG. 1 is a perspective view of a corner support clip attached to a wall of a facade coping system in accordance with the present invention.

The cover support member 88 preferably includes a support member 114, two vertical members 116 and two flange members 118. The two first vertical members 116 are bent to extend downward from opposing sides of the support member 114. The two flange members 118 are bent to extend outward from a bottom of the two vertical members 116. The two flange members 118 are attached to a top of the top member 90 with any suitable attachment process, such as Lance Lock. With reference to FIG. 1, the cover support member 72 is attached to a top of the fastener stud 104 by inserting a plurality of fasteners 75 through the first and second holes 110, 112 and securing the plurality of fasteners 75 to the fastener stud 104.

Figure 3:
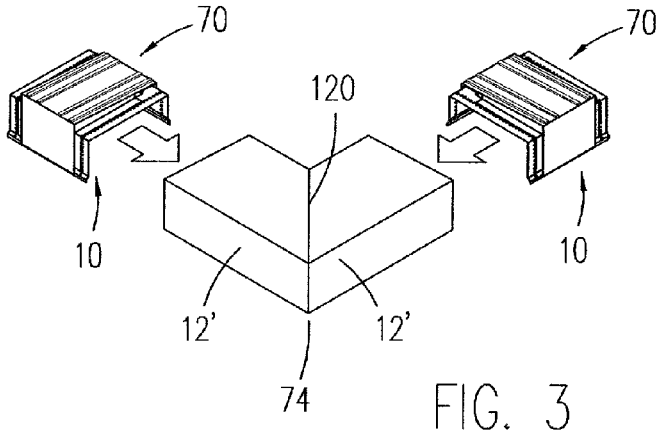
FIG. 3 is an exploded perspective view of two anchor clips and a corner coping cover of a facade coping system in accordance with the present invention.
Figure 4:
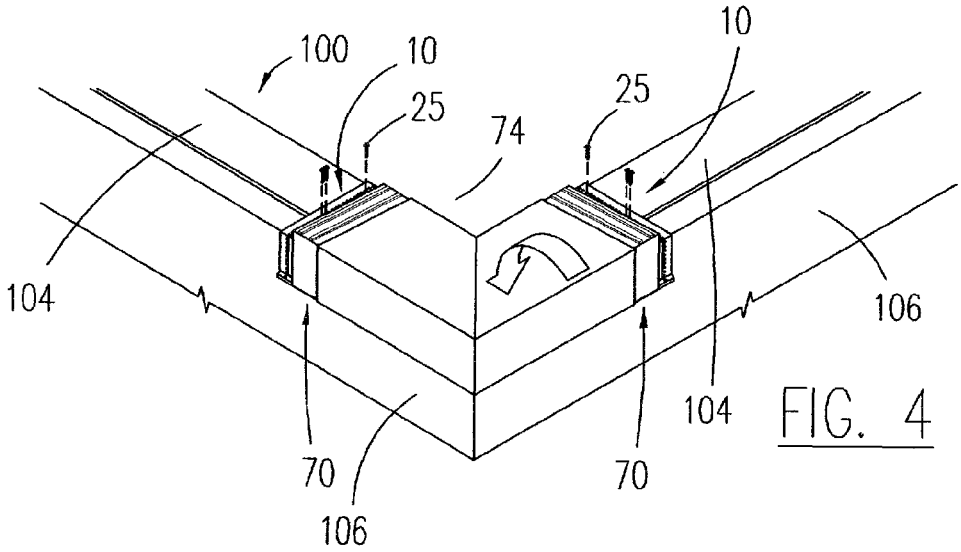
FIG. 4 is a perspective view of two anchor clips attached to two walls, two channel splices placed on the two anchor clips and a corner coping cover attached to the two anchor clips of a facade coping system in accordance with the present invention.
Figure 5:
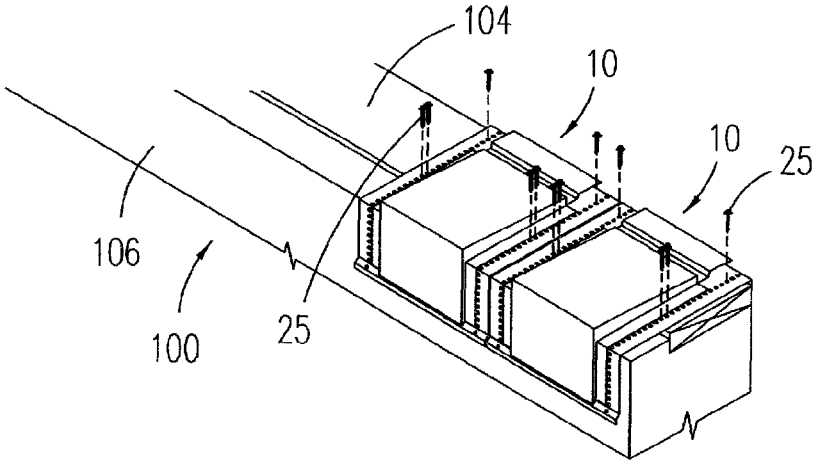
FIG. 5 is a perspective view of two adjacent anchor clips attached to a wall of a facade coping system in accordance with the present invention.

With reference to FIG. 3, the corner coping cover 74 includes two shortened coping covers 12'. A mitered end 120 is formed on one end of each shortened coping cover 12'. The mitered end is 45 degrees relative to a length of the shortened coping cover 12'. The mitered ends 120 are joined to each other with any suitable attachment process. Installing the corner coping cover 74 requires placing the splice channel 70 over the anchor clip 10 and inserting two anchor clips 10 into each open end of the corner coping cover 74. With reference to FIG. 4, the two anchor clips 10 are attached to the two fastener studs 104 with the plurality of fasteners 25.

Figure 6:
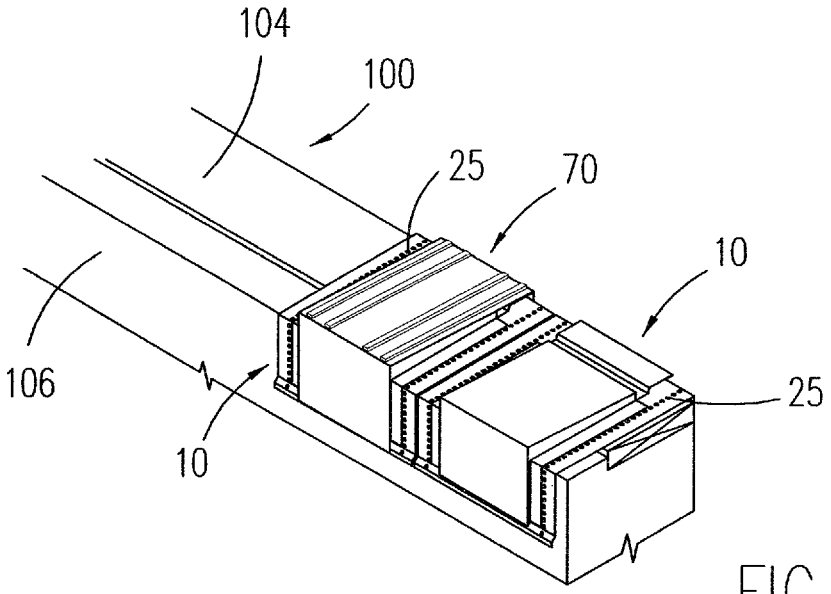
FIG. 6 is a perspective view of two adjacent anchor clips attached to a wall and a splice channel placed on one of the two anchor clips of a facade coping system in accordance with the present invention.
Figure 7:
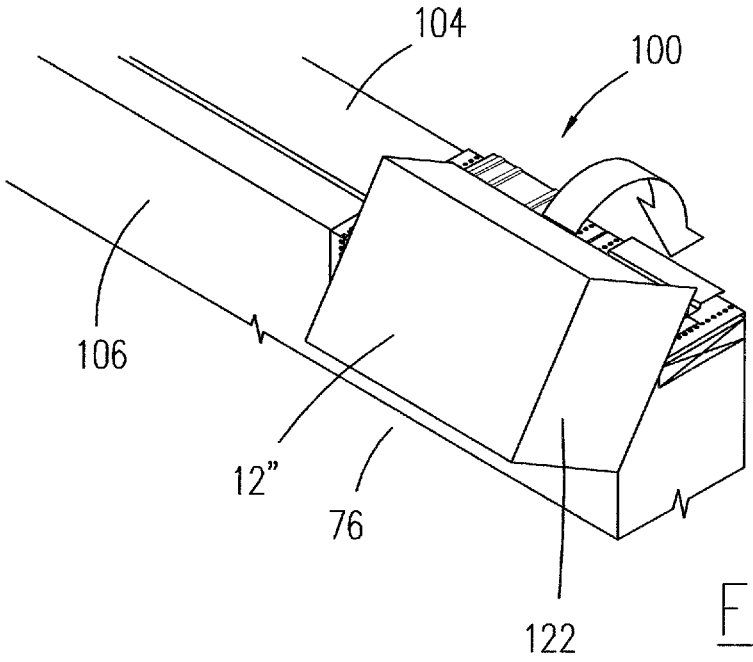
FIG. 7 is a perspective view of two adjacent anchor clips attached to a wall and an end cap coping cover hooked on the two adjacent anchor clips of a facade coping system in accordance with the present invention.

With reference to FIG. 7, the end cap coping cover 76 includes a shortened coping cover 12" and an end plate 122. The end plate 122 is attached to one end of the shortened coping cover 12" with any suitable attachment method. With reference to FIG. 6, two adjacent anchor clips 10 are attached to an end of the fastener stud 104 with a plurality of fasteners 25. The splice channel 70 is placed on the anchor clip 10, which is furthest away from an end of the wall 100. The end coping cover 76 is attached to the two adjacent anchor clips 10. The splice channel 70 seals a gap between the end cap coping cover 76 and a yet to be installed coping cover 12.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A facade coping system comprising:

at least one anchor clip having a clip support channel, a cover support and a spring support, said clip support channel includes a top member, a first side member and a second side member, said first side member extends downward from a first end of said top member, a second side member extends downward from a second end of said top member, said cover support includes a first portion and a second portion, said first portion includes a first support member, two first vertical members and two first flange members, said two first vertical members are bent to extend downward from opposing sides of said first support member, said first flange members are bent to extend outward from a bottom of said two first vertical members, said first portion is substantially perpendicular to said second portion, said first portion is attached to said top member, said second portion is attached to said second side member, said spring support includes a base member and a spring support member, said spring support member extends upward from said base member, said base member is attached to said top member, adjacent said first side member; and a coping cover includes a top surface, a first side surface and a second side surface, said first side surface extends downward from a first end of said top surface, said second side surface extends downward from a second end of said top surface, a bottom end of said first side surface is terminated with a first attachment clip, a bottom end of said second side surface is terminated with a second attachment clip.

2. The facade coping system of claim 1 wherein:

a bottom end of said first side member is terminated with a first offset flange; and a bottom end of said second side member is terminated with a second offset flange.

3. The facade coping system of claim 1 wherein:

a plurality of first holes are formed through said clip support channel adjacent a first side thereof; and a plurality of second holes are formed through said clip support channel adjacent a second side thereof.

4. The facade coping system of claim 1 wherein:

said second portion includes a second support member, two second vertical members and two second flange members, said two second vertical members are bent to extend downward from opposing sides of said second support member, said two second flange members are bent to extend outward from a bottom of said two second vertical members.

5. The facade coping system of claim 4 wherein:

a notch is formed on opposing sides of a junction between said first and second portions to create two tabs, said two tabs are attached to said two first vertical members.

6. The facade coping system of claim 1, wherein:

said two first vertical members include a trapezoidal shape.

7. The facade coping system of claim 1, further comprising:

a splice channel includes a top surface, a first side surface and a second side surface, said first side surface extends downward from a first end of said top surface and said second side surface extends downward from a second end of said top surface, at least two rows of sealant are applied to said top surface.

8. The facade coping system of claim 1, further comprising:

a corner support clip includes a corner base member and a cover support member, said corner base member includes a corner top member, a ramp member and a corner side member, one end of said ramp member extends upward from one end of said top member, said side member extends downward from the other end of said ramp member, said cover support member is attached to at top of said corner top member.

9. The facade coping system of claim 1, further comprising:

a corner coping cover includes said coping cover with a mitered end to form a mitered coping cover, two said mitered coping covers are attached to each other at mitered ends thereof.

10. The facade coping system of claim 1, further comprising:

an end cap coping cover includes said coping cover and an end plate, said end plate is attached to one end of said coping cover.

11. A facade coping system comprising:

at least one anchor clip having a clip support channel, a cover support and a spring support, said clip support channel includes a top member, a first side member and a second side member, said first side member extends downward from a first end of said top member, a second side member extends downward from a second end of said top member, said cover support includes a first portion and a second portion, said first portion includes a first support member, two first vertical members and two first flange members, said two first vertical members are bent to extend downward from opposing sides of said first support member, said first flange members are bent to extend outward from a bottom of said two first vertical members, said first portion is substantially perpendicular to said second portion, said first portion is attached to said top member, said second portion is attached to said second side member, said spring support includes a base member and a spring support member, said spring support member extends upward from said base member, said base member is attached to said top member, adjacent said first side member; and a coping cover includes a top surface, a first side surface and a second side surface, said first side surface extends downward from a first end of said top surface, said second side surface extends downward from a second end of said top surface, a bottom end of said first side surface is terminated with a first attachment clip, a bottom end of said second side surface is terminated with a second attachment clip, wherein said first attachment clip is hooked to a bottom of said first side member, said second attachment clip is hooked to a bottom of said second side member.

12. The facade coping system of claim 11 wherein:

a bottom end of said first side member is terminated with a first offset flange; and a bottom end of said second side member is terminated with a second offset flange.

13. The facade coping system of claim 11 wherein:

a plurality of first holes are formed through said clip support channel adjacent a first side thereof; and a plurality of second holes are formed through said clip support channel adjacent a second side thereof.

14. The facade coping system of claim 11 wherein:

said second portion includes a second support member, two second vertical members and two second flange members, said two second vertical members are bent to extend downward from opposing sides of said second support member, said two second flange members are bent to extend outward from a bottom of said two second vertical members.

15. The facade coping system of claim 14 wherein:

a notch is formed on opposing sides of a junction between said first and second portions to create two tabs, said two tabs are attached to said two first vertical members.

16. The facade coping system of claim 11 wherein:

said two first vertical members include a trapezoidal shape.

17. The facade coping system of claim 11, further comprising:

a splice channel includes a top surface, a first side surface and a second side surface, said first side surface extends downward from a first end of said top surface and said second side surface extends downward from a second end of said top surface, at least two rows of sealant are applied to said top surface.

18. The facade coping system of claim 11, further comprising:

a corner support clip includes a corner base member and a cover support member, said corner base member includes a corner top member, a ramp member and a corner side member, one end of said ramp member extends upward from one end of said top member, said side member extends downward from the other end of said ramp member, said cover support member is attached to at top of said corner top member.

* * * * *